United States Patent [19]

Toyoda

[11] 4,413,561

[45] Nov. 8, 1983

[54] INK FOUNTAIN DEVICES FOR PRINTING PRESS

[75] Inventor: Hideaki Toyoda, Tokyo, Japan

[73] Assignee: Komori Printing Machinery Co., Ltd., Tokyo, Japan

[21] Appl. No.: 353,985

[22] Filed: Mar. 2, 1982

[30] Foreign Application Priority Data

Mar. 10, 1981 [JP] Japan ..... 56-34302

[51] Int. Cl.[3] ..... B41F 31/04; B41F 31/06

[52] U.S. Cl. ..... 101/365

[58] Field of Search ..... 101/365, 157, 169; 118/261; 15/256.5, 256.51

[56] References Cited

U.S. PATENT DOCUMENTS

| | | | |
|---|---|---|---|
| 3,521,561 | 7/1970 | Pali et al. | 101/169 |
| 3,559,573 | 2/1971 | Hantscho | 101/365 |
| 3,699,888 | 10/1972 | Easoz | 101/365 |
| 3,978,788 | 9/1976 | Carpel et al. | 101/363 |
| 4,000,695 | 1/1977 | Perretta | 101/365 |
| 4,050,380 | 9/1977 | Pfizenmaier | 101/365 |
| 4,058,058 | 11/1977 | Hantscho | 101/365 |

*Primary Examiner*—J. Reed Fisher

*Attorney, Agent, or Firm*—Remy J. VanOphem

[57] ABSTRACT

In an ink fountain device for a printing press of the type wherein a plurality of divided blade sections are adjustable toward and away from an ink fountain roller and a covering plate covering the divided blade sections is attracted to the divided blade sections by permanent magnets embedded in the divided blade sections, an inner end of the covering plate is spaced a predetermined distance away from the ink fountain roller and slanted downwardly and an angle between the slanted surface and an upper surface of the covering plate is made to be smaller than that between the upper surface and a tangent passing through a point on a periphery of the ink fountain roller confronting an inner end of the divided blade section. According to this construction bending up of the covering plate can be prevented so that leakage of the ink into a gap between the divided blade sections and the covering plate can be prevented.

2 Claims, 5 Drawing Figures

INK FOUNTAIN DEVICES FOR PRINTING PRESS

BACKGROUND OF THE INVENTION

This invention relates to an ink fountain device for continuously discharging printing ink in an ink fountain at a constant rate.

The ink fountain device for supplying printing ink to a printing plate mounted on the plate cylinder for a rotary printing press including an ink fountain roller, for discharging the printing ink in an ink fountain at a predetermined rate, and a plurality of groups of rollers which distribute and uniformly smooth the discharged ink. An ink film is then transferred to the surface of the printing plate. The ink fountain is defined by an ink fountain roller supported by opposite side frames, and a fountain blade made of a thin steel plate and secured to a support with its front edge in abutment with the periphery of the fountain roller. The printing ink stored in the ink fountain flows out as a thin ink film through a narrow gap formed between the periphery of the fountain roller and the fountain blade. A plurality of adjusting screws are threaded through the support at a spacing of about 20 to 50 mm. The inner ends of the adjusting screws engage the fountain blade so that when the adjusting screws are independently reciprocated the gap between the fountain blade and the fountain roller is varied so as to adjust the quantity of ink in respective sections divided in the axial direction of the fountain roller, that is in the axial direction of the plate cylinder, thus enabling adjustment of the quantity of ink in accordance with a tone of an image on the printing plate.

In an ink fountain device constructed as above described, however, since the fountain blade is made of a single continuous plate, where it is desired to decrease the quantity of the ink at portions corresponding to two spaced apart adjusting screws and to increase the quantity of the ink at a portion corresponding to an adjusting screw located between the two spaced apart adjusting screws, even when the central adjusting screw is retracted while the two spaced adjusting screws are maintained in their forward positions, the fountain blade would not respond to the adjustment of the central adjusting screw but maintained its state deformed by the two outside adjusting screws. For this reason, it was necessary to slightly retract the adjusting screws on both sides which resulted in a rough adjustment. Furthermore, when one screw is advanced, screws on both sides thereof are influenced, preventing a correct adjustment.

To eliminate this disadvantage, a divided blade type fountain device has been proposed in which the fountain blade is divided into a plurality of sections along the axis of the fountain roller so that the respective blade sections can be independently adjusted. With this construction, however, as the blade is divided into a plurality of sections, the ink permeates into the sliding surfaces between the support and the blade sections and further into the gap adjusting member through gaps between the divided blade sections, such ink rendering it impossible to finely adjust the quantity of the ink to be fed due to ink sludge or to move the divided sections. Furthermore, when the color of the ink is and the used ink remains, the used ink and the new ink are mixed. Accordingly, it was necessary to completely remove the used ink, thus requiring complicated maintenance.

SUMMARY OF THE INVENTION

It is, therefore, an object of the present invention to provide an improved ink fountain device capable of perfectly preventing leakage of ink through gaps between adjacent blade sections.

Another object of this invention is to provide an improved ink fountain device capable of smoothly reciprocating the divided blades and to, thus, eliminate labor in cleaning the blades.

According to this invention, an ink fountain device is provided for a printing press including an ink fountain roller, an ink fountain frame inclined toward the ink fountain roller, a plurality of divided blade sections juxtaposed on the ink fountain frame with their adjacent sides in close contact, a covering plate covering entire surfaces of the divided sections, the covering plate being made of magnetic material and removably mounted on the divided blade sections, a plurality of permanent magnets embedded in the divided blade sections for attracting the covering plate to the divided blade sections, an inner end of the covering plate being spaced a predetermined distance from a periphery of the ink fountain roller and slanted downwardly, and an angle between the slanted surface and upper surfaces of the covering plate being smaller than an angle between a tangent passing through a point on the periphery of the ink fountain roller confronting inner ends of the divided blade sections and the upper surfaces thereof.

BRIEF DESCRIPTION OF THE DRAWINGS

Further objects and advantages of the invention can be more fully understood from the following detailed description taken in conjunction with the accompanying drawings in which.

DESCRIPTION OF THE PREFERRED EMBODIMENT

Figure 1:
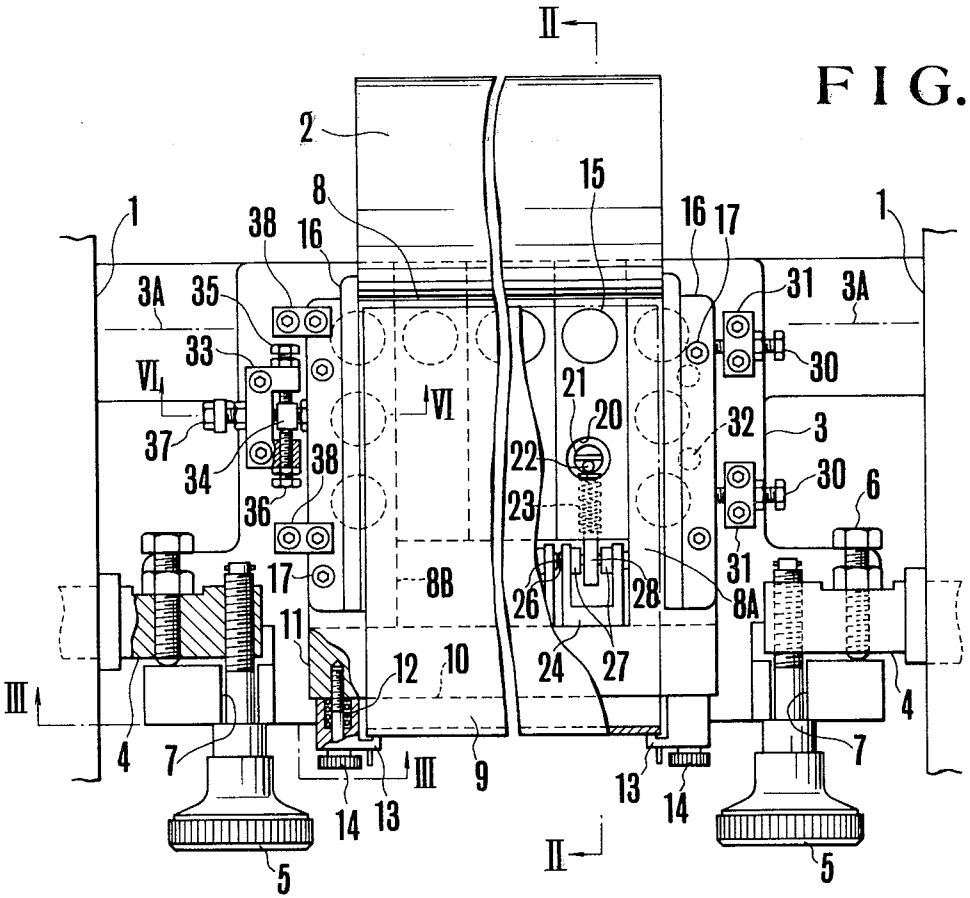
FIG. 1 is a plan view showing one embodiment of the ink fountain device in accordance with the present invention and utilized in a printing press.
Figure 2:
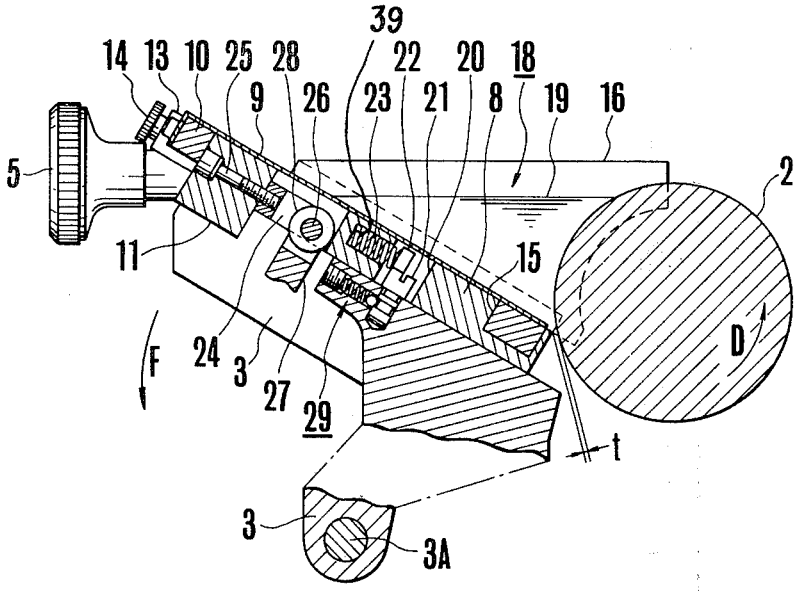
FIG. 2 shows an enlarged sectional view taken along lines II—II in FIG. 1.
Figure 3:
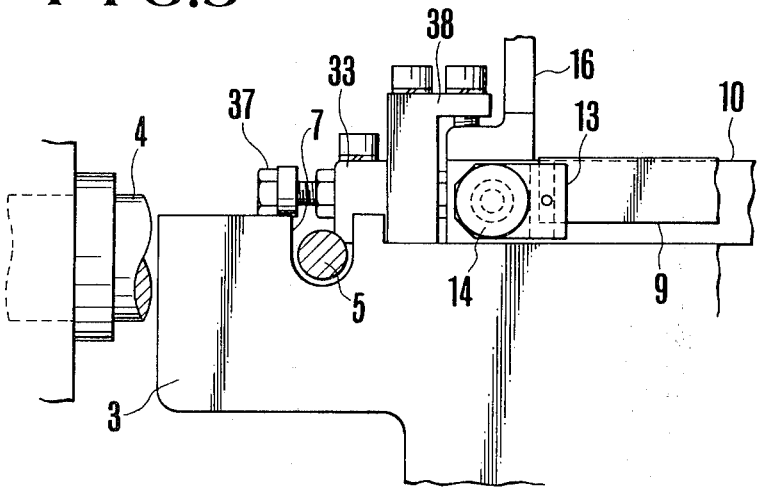
FIG. 3 shows an enlarged sectional view taken along lines III—III in FIG. 1.
Figure 5:
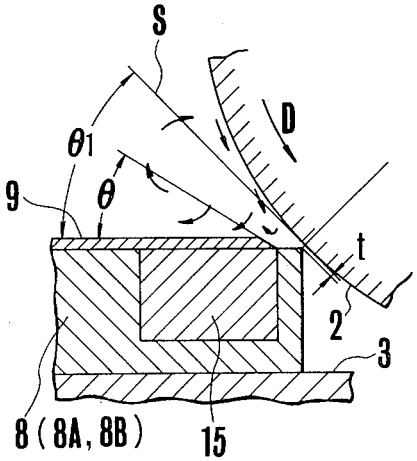
FIG. 5 is an enlarged sectional view showing portions near the tip of a blade section.

Referring now to the accompanying drawings, an ink fountain roller 2 is rotatably supported by side frames 1 to rotate in a direction D shown in FIG. 5. An ink fountain frame 3 is provided behind the fountain roller 2. The ink fountain frame 3 has the same length as that of the fountain roller 2 and is supported by a pivot shaft 3A shown in FIG. 2 and disposed below the ink fountain roller 2 to be rotatable in a direction F as shown in FIG. 2. Knurled hand knobs 5 and bolts 6 are threaded from opposite sides into stationary brackets 4 projecting inwardly from the side frames 1. After inserting the knobs 5 into U shaped slots 7 of the ink fountain frame 3 and then by tightening the knobs 5, the ink fountain frame 3 is secured to the position shown in FIGS. 1 and 2. When the knobs 5 are loosened, the ink fountain frame 3 can be rotated in the direction F (FIG. 2), for cleaning.

The upper surface of the ink fountain frame 3 is inclined toward the fountain roller 2 and a plurality of rectangular divided blades or blade sections 8 are mounted on the ink fountain frame 3 with their side edges abutting each other. The blade sections 8 are reciprocated toward and away from the periphery of the ink fountain roller 2. The blade sections 8 are juxtaposed in the axial direction of the ink fountain roller 2. The blade sections 8A and 8B on the opposite sides have a length slightly shorter than the width of the ink fountain frame 3. The other blade sections 8, and substantially one half of the blade sections 8A and 8B, are covered by a covering plate 9 made of a thin steel sheet. Beneath the rear end of the covering plate 9 is disposed a square bar 10 having substantially the same length as the covering plate 9 and extending in the direction of the width thereof. A square stay 11 is provided having a length somewhat longer than the square bar 10 on the ink fountain frame 3 at the rear end thereof, and clamp members 13 are secured to the opposite ends of the square stay 11 by bolts 14 and urged by compression springs 12 to move away from the square stay 11. The opposite ends of the covering plate 9 are clamped by the clamp member 13.

Each of the divided blade sections 8, 8A and 8B are embedded with a plurality of permanent magnets 15 which magnetically attract the covering plate 9 to the upper surface of the blade sections. L shaped ink dams or end plates 16 are secured to the upper surfaces of the end blade sections 8A by bolts 17. An ink fountain 18 is defined by the end plates 16, covering plate 9, divided blade sections 8, and the periphery of the fountain roller 2 for containing a quantity of ink 19.

The blade sections 8, except the end sections 8A and 8B, are formed with perforations or through holes 20 to receive heads of eccentric pins 21 threaded into the ink fountain frame 3. A compression spring 23 is interposed between a spring seat 22 provided for the eccentric portion of each eccentric pin 21 and the rear wall of a spring groove 39 provided for each blade section 8 for biasing the same to move away from the fountain roller 2. When each eccentric pin 21 is rotated with a driver by 180° from the position shown in FIGS. 1 and 2, the spring seat 22 is displaced to release the biasing force of the compression spring 23 whereby the blade sections 8 can be removed from the ink fountain frame 3.

Figure 4:
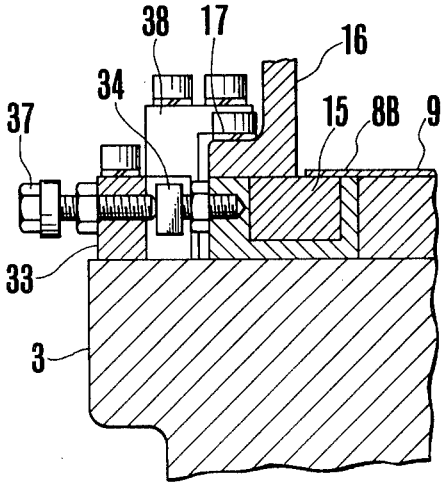
FIG. 4 is an enlarged sectional view taken along lines IV—IV in FIG. 1.

On the front end of the square stay 11 is secured a U shaped bracket 24 by a bolt 25 threaded into the square stay 11. An eccentric pin 26 is rotatably supported by the U shaped bracket 24. The eccentric pin 26 is constituted by bearings engaging the opposing ends of the U-shaped bracket 24 and an eccentric portion between the bearings. The opposite ends of a U shaped adjusting lever 27 are secured to the bearings of the eccentric pin 26. Rollers 28 are fitted on the eccentric portions with their peripheries engaged with the rear end of the blade sections 8. When the adjusting lever 27 is rotated by drive means, not shown, the eccentric pins 26 integral therewith are rotated so that the roller 28 reciprocates the blade sections 8 by the eccentric action of the pin 26 so as to adjust the gaps t between the tips of the blade sections 8 and the periphery of the ink fountain roller 2. A click mechanism 29 is provided for limiting the rotation of the eccentric pin 26 caused by the compression spring 23. A pair of adjusting bolts 30 are threaded into bushings 31 for positioning the end blade section 8A at two positions, and an embedded bolt 32 is provided for the blade section 8A for securing the same to the ink fountain frame 3 after the position of the blade section 8A has been determined. On one side of the other blade section 8B a U shaped block 33 is secured to the ink fountain frame 3 and adjusting bolts 35, 36 and 37 are threaded through the U shaped block 33 to engage the three sides of a sqaure head of a press bolt 34 threaded into the ink fountain frame 3. As shown in FIG. 4, the end plates 16 are secured to the ink fountain frame 3 by fasteners 38.

As shown in FIG. 5, the length of the covering plate 9 is determined such that its fore end is spaced a predetermined distance from the periphery of the ink fountain roller. A gap t of at least 3 mm will be formed between the fore end of the blade sections and the periphery of the fountain roller 2. The fore end of the covering plate is slanted to make an angle $\theta$ between the inclined surface and the upper surface of the covering plate, the angle $\theta$ being smaller than the angle $\theta$ between a tangent passing through a point on the periphery of the fountain roller 2 which confronts the blade section and the upper surface thereof. One of the permanent magnets is provided at a portion corresponding to the tip of the covering plate 9.

To assemble the ink fountain device described above, the end blade section 8A is positioned by adjusting the adjusting bolts 30 such that its front end would contact the periphery of the fountain roller in an exact parallel relation. Then, the other blade sections 8 are juxtaposed on the ink fountain frame 3 with their edges in abutting relationship. Thereafter, the other adjusting bolt 37 is tightened to cause adjacent blade sections 8 to contact each other at a suitable pressure. After urging the end blade sections 8A and 8B against the periphery of the ink fountain roller 2 at a slight pressure to set a minimum quantity of the flowing out ink, the blade section 8A is secured to the ink fountain frame 3 with the embedded bolt 32. The other end blade section 8B is held by adjusting bolts 35 and 36. After setting the blade sections 8, 8A and 8B in this manner, the end plates 16 and covering plate 9 are secured to the ink fountain frame 3 thus completing an ink fountain. A quantity of printing ink 19 is poured into the ink fountain. Then adjusting mechanisms, not shown, provided for the respective divided blade sections, are operated to swing the adjusting lever 27 for rotating rollers 28 to reciprocate the divided blade sections by the eccentricity of the rollers for adjusting the gap t, that is the quantity of flowing out ink for respective divided blade sections.

When the ink fountain roller 2 is rotated in the direction of arrow D (see FIG. 2) at the time of starting the printing operation, by the wedge action created by this rotation, the covering plate and respective divided sections 8, the ink is forced out through the gap t and after being kneaded by a plurality of groups of inking rollers an ink film is supplied to the plate cylinder. Since all of the blade sections 8, 8A and 8B are covered by the covering plate 9 and moreover as the covering plate 9 is attracted to the blade sections by the permanent magnets, there is no leakage of the printing ink into the sliding surfaces between the blade sections and the ink fountain frame 3 through gaps between adjacent blade sections. As shown in FIG. 4 although narrow areas between the end plates 16 and the covering plate 9 are not covered by the covering plate 9, since it is attracted by the permanent magnets this would not cause leakage of the ink. Further, as shown by the arrows in FIG. 5, a portion of the ink flowing out through the gap t when the ink fountain roller 2 is rotated flows along the surface of the covering plate 9 to move away from the gap t, such motion resembling the motion of the ink which occurs when a cylinder having a diameter of 20 mm is rotated. Since the pressure in the ink is increased by the wedge action of the blade sections 8 and the periphery of the ink fountain roller, when the tip of the covering plate 9 extends to the inner ends of the blade sections 8 the tip would be bent upwardly. However, since the tip of the covering plate 9 terminates at a short distance, for example about 3 mm, from the inner ends of the blade sections 8, and moreover since the tip is slanted the rotation of the ink fountain roller 2 applies a clamping force to the inclined tip of the covering plate 9 it would not be bent upwardly.

To wash the blade sections 8, the covering plate 9 is removed, the adjusting bolt 37 is loosened, and then the eccentric pins 21 urged against the blade sections 8 are rotated 180° with a screw driver. Then the blade sections 8 are released and can be readily removed. After washing, the blade sections are mounted again and the adjusting bolt 37 is tightened to accurately secure the blade sections to the original position.

As above described according to this invention it is possible to independently adjust the gaps between respective divided sections and the periphery of the ink fountain roller so that the quantity of the ink to be transferred can be finely adjusted in accordance with the image of the printed matter. Furthermore, as the tendency of bending up the tip of the covering plate can be prevented by slanting the tip thereof, the ink is prevented from permeating between the covering plate and the blade sections. As a consequence, washing or cleaning of the blade sections can be eliminated. It should be understood that the invention is not limited to the specific embodiment described above and many changes and modifications will be obvious to one skilled in the art.

What is claimed is:

1. An ink fountain device for a printing press comprising:

an ink fountain roller;

an ink fountain frame inclined toward said ink fountain roller;

a plurality of divided blade sections juxtaposed on said ink fountain frame, with their adjacent sides in close contact;

a covering plate covering entire surfaces of said divided blade sections, said covering plate being made of magnetic material and being removably mounted on said divided blade sections;

a plurality of permanent magnets embedded in said divided blade sections for attracting said covering plate to said divided blade sections;

an inner end of said covering plate being spaced a predetermined distance from a periphery of said ink fountain roller and slanted downwardly; and an angle between the slanted surface and upper surfaces of said covering plate being smaller than an angle between a tangent passing through a point on the periphery of said ink fountain roller confronting inner ends of said divided blade sections and the upper surfaces thereof.

2. The ink fountain device of claim 1 wherein said predetermined distance is more than 3 mm.

* * * * *

UNITED STATES PATENT AND TRADEMARK OFFICE

CERTIFICATE OF CORRECTION

PATENT NO. : 4,413,561

DATED : November 8, 1983

INVENTOR(S) : Hideaki Toyoda

It is certified that error appears in the above-identified patent and that said Letters Patent is hereby corrected as shown below:

Column 1. Line 65, after "ink is" insert ---- changed ----.

Signed and Sealed this

Tenth Day of July 1984

[SEAL]

*Attest:*

GERALD J. MOSSINGHOFF

*Attesting Officer*

*Commissioner of Patents and Trademarks*